US009110439B2

(12) United States Patent
Fujiwara et al.

(10) Patent No.: US 9,110,439 B2
(45) Date of Patent: Aug. 18, 2015

(54) CARTRIDGE HAVING A GRIP PROVIDED ON A FRAME

(71) Applicant: Canon Kabushiki Kaisha, Tokyo (JP)

(72) Inventors: Akihiro Fujiwara, Mishima (JP); Susumu Nittani, Suntou-gun (JP); Masato Tanabe, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/037,097

(22) Filed: Sep. 25, 2013

(65) Prior Publication Data

US 2014/0086629 A1 Mar. 27, 2014

(30) Foreign Application Priority Data

Sep. 27, 2012 (JP) ..... 2012-214640

(51) Int. Cl.
*G03G 21/18* (2006.01)

(52) U.S. Cl.
CPC ..... *G03G 21/1839* (2013.01)

(58) Field of Classification Search
CPC ..... G03G 21/1839; G03G 21/1846
USPC ..... 399/111, 107
See application file for complete search history.

(56) References Cited

U.S. PATENT DOCUMENTS

| | | | | |
|---|---|---|---|---|
| 5,943,528 | A * | 8/1999 | Akutsu et al. | 399/111 |
| 6,141,508 | A * | 10/2000 | Sasaki et al. | 399/111 |
| 6,834,171 | B2 | 12/2004 | Nittani | |
| 7,489,886 | B2 | 2/2009 | Ito | |
| 8,483,589 | B2 * | 7/2013 | Uneme et al. | 399/111 |
| 2003/0185587 | A1 * | 10/2003 | Kawai et al. | 399/111 |
| 2006/0251447 | A1 * | 11/2006 | Baek | 399/111 |
| 2008/0025756 | A1 * | 1/2008 | Ahn et al. | 399/111 |

FOREIGN PATENT DOCUMENTS

| | | | |
|---|---|---|---|
| JP | 11-167257 | A | 6/1999 |
| JP | 11-184353 | A | 7/1999 |
| JP | 2012-008501 | A | 1/2012 |

* cited by examiner

*Primary Examiner* — Susan Lee
(74) *Attorney, Agent, or Firm* — Canon USA Inc IP Division

(57) ABSTRACT

A cartridge detachably mountable to an apparatus body of an image forming apparatus, includes a grip member that is provided on the frame member for gripping the cartridge when the cartridge is mounted on or dismounted from the apparatus body, the grip member including a first molded member that is integrally molded with the frame member, and a second molded member that is integrally molded on the first molded member with a second resin after the molding of the first molded member.

14 Claims, 9 Drawing Sheets

CARTRIDGE HAVING A GRIP PROVIDED ON A FRAME

BACKGROUND OF THE INVENTION

1. Field of the Invention

The present disclosure relates to a process cartridge used in an electrophotographic image forming apparatus.

2. Description of the Related Art

An image forming apparatus that uses an electrophotographic process performs image recording by uniformly charging a photosensitive drum, which is an image bearing member, to form a latent image based on selective exposure on the photosensitive drum, developing the latent image with a toner, which is a developer, transferring the toner image onto a recording medium, and applying heat and pressure onto the transferred toner image to fix the toner image on the recording medium.

Such an apparatus requires toner replenishment and maintenance of the various parts relating to the above-described image forming process. To facilitate the toner replenishment operation and maintenance, process cartridges have been developed. Specifically, the parts relating to the image forming process, such as the photosensitive drum, charging unit, and cleaning unit, are integrated into one frame member as a cartridge. This cartridge detachably mountable to the image forming apparatus body. In this process cartridge system, since the user can perform the apparatus maintenance by himself/herself, operability can be greatly improved. Consequently, such a process cartridge system is now widely employed.

In this process cartridge system, when replacing a process cartridge, the user needs to pull the process cartridge from the image forming apparatus body and push the process cartridge to a predetermined mounting position. Japanese Patent Application Laid-Open No. 2012-8501 discusses a configuration in which a grip member that lets the user grip the process cartridge is provided on a frame member of the process cartridge. By providing such a grip member, the user can easily mount and dismount the process cartridge, so that operability is improved.

One example of a method for providing such a grip member on a frame member of the process cartridge is to form the grip member integrally with the frame member using a resin. In this case, the thickness of the grip member should be limited to the thickness of the frame member portion. This is because a grip member having a greater thickness is more difficult to mold into a desired shape due to the occurrence of sink marks.

During the mounting/removal operation of the process cartridge, since the grip member has to support almost the entire weight of the frame member side including the toner, the grip member needs to have a certain level of strength. However, depending on the design of the process cartridge, it may not be possible to make the grip member thick enough. In such a case, there may be an adverse impact on usability due to flexing in the grip member as a result of the load applied during the mounting/removal operation.

SUMMARY OF THE INVENTION

The present disclosure is directed to a cartridge capable of improving the strength of a grip member on a frame member in a cartridge detachably mountable to an image forming apparatus.

According to an disclosed herein, a cartridge capable detachably mountable to an apparatus body of an image forming apparatus includes a frame member formed of a first resin, and a grip member that is provided on the frame member for gripping the cartridge when the cartridge is mounted on or dismounted from the apparatus body, the grip member including a first molded member that is integrally molded with the frame member, and a second molded member formed of a second resin that is integrally molded with the first molded member after the molding of the first molded member, wherein the second molded member is molded such that a thickness of the grip member becomes thicker in a mounting and dismounting direction in which cartridge is mounted on or dismounted from the apparatus body.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

The dimensions, material, shape, and relative arrangement of the constituent parts described in the exemplary embodiments of the present disclosure may be changed as appropriate according to the configuration of the apparatus to which the disclosure is applied and other various conditions. Specifically, the scope of the present invention is not limited to the following exemplary embodiments.

The present disclosure relates to a process cartridge used in an electrophotographic image forming apparatus, such as a copying machine and a printer, that employs an electrophotographic method. This electrophotographic image forming apparatus (hereinafter, "image forming apparatus") forms an image on a recording material (recording medium) using an electrophotographic method. Examples of the electrophotographic image forming apparatus include a printer (a laser beam printer, a light-emitting diode (LED) printer etc.), a copying machine, a facsimile apparatus, a word processor, a multifunction peripheral (multifunction printer) and the like.

In the following first exemplary embodiment according to the present disclosure, a full-color image forming apparatus in which four process cartridges that include a development device can be detachably mounted will be described as an example of the image forming apparatus. However, the number of process cartridges mounted on the image forming apparatus is not limited to four, and may be appropriately set as required. For example, for an image forming apparatus that forms monochrome images, the number of process cartridges mounted on the image forming apparatus is one.

(Overall Schematic Configuration of the Image Forming Apparatus)

Figure 2:
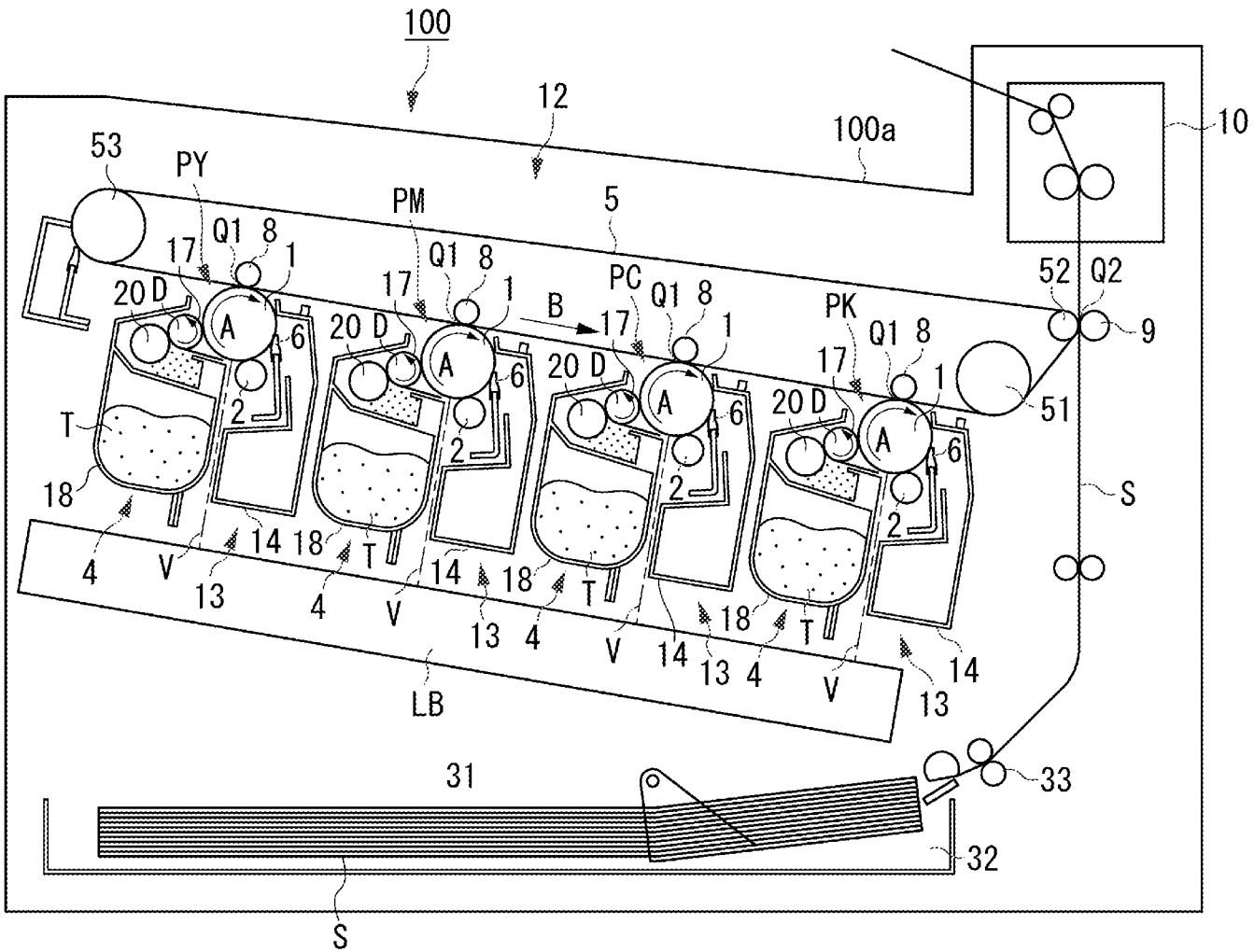
FIG. 2 is a schematic cross-sectional view of an image forming apparatus according to an exemplary embodiment.

FIG. 2 is a schematic view of a color electrophotographic image forming apparatus according to an exemplary embodiment of the present disclosure. This image forming apparatus 100 is a four-color full-color laser printer that uses an electrophotographic process to form a color image on a recording medium S. The image forming apparatus 100 is a process cartridge type. A process cartridge P is mounted on the image forming apparatus 100, and a color image is formed on the recording medium (recording material) S. In the following description, the image forming apparatus (hereinafter, "apparatus body") 100 is the apparatus configuration portion that excludes the process cartridge (hereinafter, "cartridge") P.

In the apparatus body 100, first to fourth cartridges P (PY, PM, PC, and PK) are horizontally arranged in a line. Each cartridge P includes the same electrophotographic process mechanism as the others. However, the color of a developer (hereinafter, "toner") T and an amount of the toner T filling the cartridge are different. A rotational drive force is transmitted from the apparatus body 100 to the cartridge P. Further, a (not illustrated) bias (charging bias, developing bias etc.) is supplied from the apparatus body 100 to the cartridge P.

The first cartridge PY contains yellow (Ye) toner in a development frame member 18. Similarly, the second cartridge PM contains magenta (Mg) toner, the third cartridge PC contains cyan (Cy) toner, and the fourth cartridge PK contains black (Bk) toner in the development frame member 18, respectively. Further, a toner image of each color is formed on the face of a respective photosensitive drum 1.

A laser scanner unit LB as an exposure unit is provided at a lower portion of the cartridges P (PY, PM, PC, and PK). This laser scanner unit LB outputs laser light V corresponding to image information. The laser light V scans and exposes the face of the photosensitive drum 1.

An intermediate transfer belt unit 12 as a primary transfer member is arranged at an upper portion of the cartridges P (PY, PM, PC, and PK). The intermediate transfer belt unit 12 includes a driving roller 51, a secondary transfer counter roller 52 and a driven roller 53, around which a flexible transfer belt 5 is wound. A drive roller 51 is rotatably driven by a (not illustrated) power source provided in the apparatus body 100, so that the transfer roller 5 is rotated in the direction of the arrow B in FIG. 2. A top side of the photosensitive drum 1 of each cartridge P is in contact with the transfer belt 5. That contact portion (a primary transfer nip portion) Q1 is a primary transfer portion. On the inner side of the transfer belt 5, a primary transfer roller 8 is provided facing the photosensitive drum 1. Further, a secondary transfer roller 9 as a secondary transfer unit is provided at a position facing the secondary transfer counter roller 52. A contact portion (a secondary transfer nip portion) Q2 between the transfer belt 5 and the secondary transfer roller 9 is a secondary transfer portion.

A feed unit 31 is provided at a lower portion of the laser scanner unit LB. This feed unit 31 includes a tray 32 in which the recording medium S is stacked and housed, and a feeding roller group 33.

(Image Forming Operation)

The operation for forming a full-color image is as follows. The photosensitive drum 1 of each cartridge P (PY, PM, PC, and PK) is rotatably driven at a predetermined speed in the direction of arrow A. The transfer belt 5 is also rotatably driven at a speed corresponding to the speed of the photosensitive drum 1 in the direction of arrow B (the forward direction of the photosensitive drum rotation). The laser scanner unit LB is also driven. In synchronization with this driving, at each cartridge P, a charging roller 2 uniformly charges the surface of the photosensitive drum 1 to a predetermined polarity and potential. The laser scanner unit LB scans and exposes the surface of each photosensitive drum 1 with laser light V based on the image signal for each color. Consequently, an electrostatic latent image based on the image signal of the corresponding color is formed on the surface of each photosensitive drum 1. The formed electrostatic latent image is rotated in the direction of arrow D in FIG. 2, and developed by the developing roller 17.

Based on such an electrophotographic image forming process, a Ye color toner image corresponding to the yellow component of the full-color image is formed on the photosensitive drum 1 of the first cartridge PY. Then, this toner image is subjected to primary transfer onto the transfer belt 5. The toner images of the second cartridge PM, the third cartridge PC, and the fourth cartridge PK are similarly superimposed on the transfer belt 5 to form the four-color, full-color toner image.

On the other hand, at a predetermined control timing, the recording medium S is separated one sheet at a time from the feed tray 32. The recording medium S is guided to the secondary transfer nip portion Q2, which is the portion where the secondary transfer roller 9 and the transfer belt 5 are in contact. Consequently, while the recording medium S is conveyed through the secondary transfer nip portion Q2, the four superimposed toner images on the transfer belt 5 are successively transferred collectively onto the face of the recording medium S.

The recording medium S is separated from the face of the transfer belt 5, and guided to a fixing unit 10. Then, the recording medium S is subjected to heat and pressure at a fixing nip portion. Consequently, each of the color toner images is fixed on the recording medium S. The recording medium S then leaves the fixing unit 10, and is discharged onto a discharge tray 100*a* on an upper face of the apparatus body.

(Overall Configuration of the Cartridge)

In the present exemplary embodiment, the first to fourth cartridges P (PY, PM, PC, and PK) have the same electrophotographic process mechanism, but the color of the contained toner and filling amount of the toner are different. The cartridges P have a cleaning unit 13 and a development unit 4. However, the configuration of the cartridges P described here is an example. The present invention is not limited to this configuration.

Figure 4:
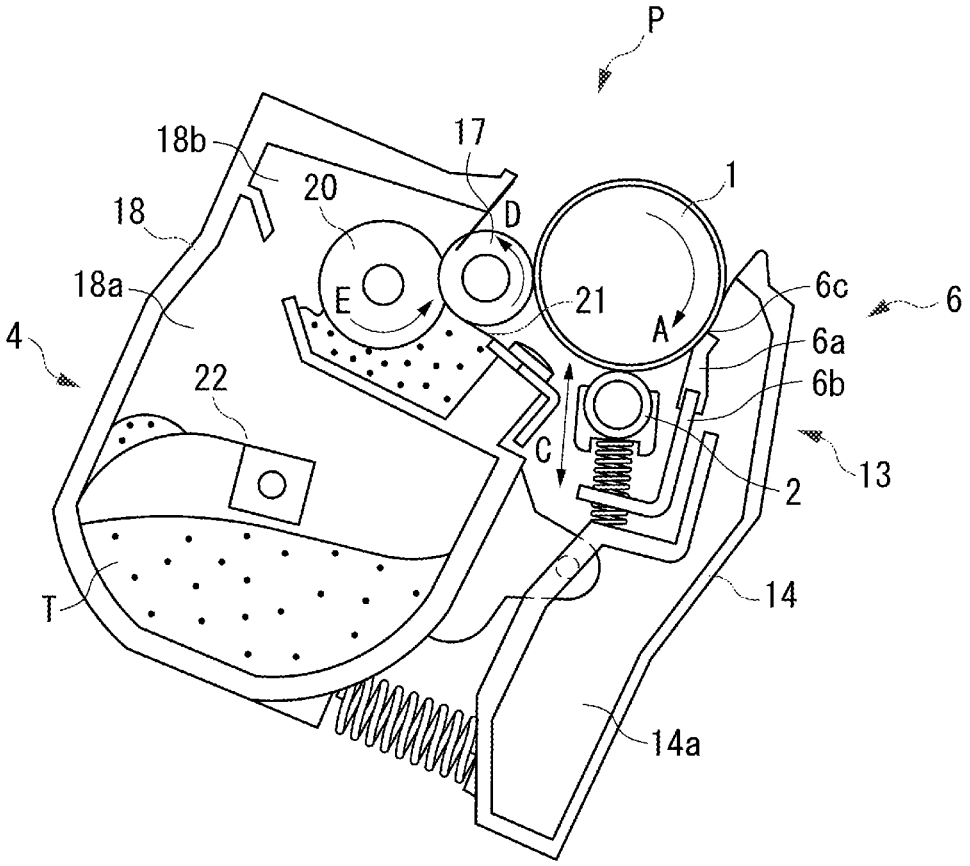
FIG. 4 is a schematic cross-sectional view of a process cartridge according to an exemplary embodiment.

FIG. 4 is a schematic cross-sectional view of a process cartridge according to the present exemplary embodiment. As illustrated in FIG. 4, the cleaning unit 13 includes in a cleaning member 14 the photosensitive drum 1, the charging roller 2, and a cleaning blade 6. The photosensitive drum 1 is rotatably supported on the cleaning member 14. A drive force from a (not illustrated) drive motor in the apparatus body is transmitted to the photosensitive drum 1, so that the photosensitive drum 1 is rotatably driven at a predetermined speed in the direction of arrow A in FIG. 2 or 4. The charging roller 2 is a contact type charging member that is rotated by contacting the photosensitive drum 1. The cleaning blade 6 is configured from an elastic rubber blade (hereinafter, "rubber blade") 6*a* and a support plate 6*b*. A tip section 6*c* of the rubber blade 6*b* abuts on the photosensitive drum 1 in the direction counter to the rotation of the photosensitive drum 1. The cleaning blade 6 removes residual toner on the photosensitive drum 1. The removed toner is collected in a removed toner collection unit 14*a* in the cleaning member 14.

Although the cleaning member 14 illustrated in FIG. 4 has a different cross-sectional configuration to the cleaning members 14 illustrated in the other figures, its functions are not different, they are essentially the same.

On the other hand, the development unit 4 includes the development frame member 18 as a member for supporting each of the elements in the development unit 4. A development roller 17 that contacts the photosensitive drum 1 and rotates in the direction of arrow D illustrated in FIG. 4 is provided in the development unit 4. Further, a developer supply roller (hereinafter, "supply roller") 20 acting as a developer supply member that rotates in the direction of arrow E illustrated in FIG. 4 is arranged in the development unit 4. This supply roller 20 contacts a periphery of the development roller 17. The supply roller 20 supplies toner onto the development roller 17, and wipes off from the development roller 17 residual toner T on the development roller 17 that was not used in development. Further, a development blade 21 acting as a developer regulation member that controls the thickness of the toner T layer supplied onto the development roller 17 by the supply roller 20 is arranged in the development unit 4.

The toner T is contained in a toner chamber 18*a* acting as a developer chamber that is formed in the development frame member 18. A developer conveyance member 22 that is rotatably supported on the development frame member 18 is provided in the toner chamber 18*a*. The developer conveyance member 22 stirs the toner T contained in the toner chamber 18*a*, and conveys toner T to a development chamber 18*b* in which the development roller 17 and the supply roller 20 are provided. In the development unit, which is a contact unit of the photosensitive drum 1 with the development roller 17, the toner T conveyed to the development roller 17 adheres to the electrostatic latent image on the surface of the photosensitive drum 1, and the latent image is developed by a predetermined development bias applied on the development roller 17 from a (not illustrated) power source in the apparatus body.

(Description of the Configuration for Mounting Cartridge in Apparatus Body)

Figure 3:
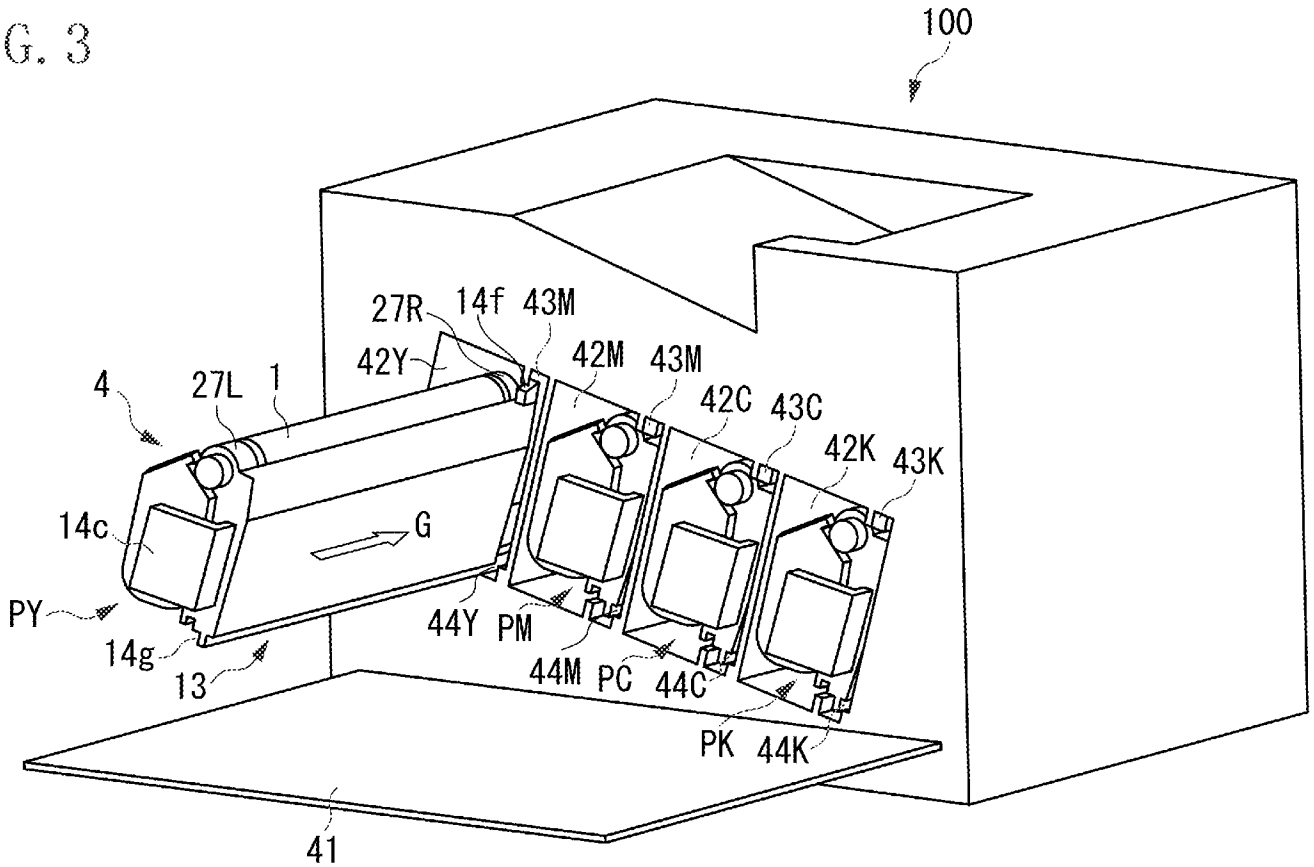
FIG. 3 is a perspective view of an image forming apparatus according to an exemplary embodiment.

Next, the configuration for mounting the cartridge P in the apparatus body 100 will be described with reference to FIG. 3. FIG. 3 is a perspective view illustrating the state before the cartridge P is mounted on the apparatus body 100.

In the present exemplary embodiment, when mounting the cartridge P on the apparatus body 100, a grip member 14*c* provided in the cleaning frame member 14 grips the cartridge P. The direction in which the cartridge P is mounted on the apparatus body 100 is the direction parallel to the shaft direction of the photosensitive drum 1 (the direction of the arrow G in FIG. 3). Specifically, the cartridge P is mounted from the near side to the far side as illustrated in FIG. 3.

In FIG. 3, a door 41 that can open and close is provided on the near side of the apparatus body 100. When the door 41 is open, a mounting section 42 (42Y, 42M, 42C, and 42K) of the four cartridges P (PY, PM, PC, and PK) is exposed. An upper mounting guide 43 (43Y, 43M, 43C, and 43K) and a lower mounting guide 44 (44Y, 44M, 44C, and 44K) that extend from the near side to the far side of the apparatus body 100 are provided on an upper side and a lower side of each mounting section 42, respectively. Further, an upper guided member 14*f* and a lower guided member 14*g* provided on the cleaning frame member 14 of the cartridge P are engaged with the upper mounting guide 43 and the lower mounting guide 44, respectively, of the apparatus body 100, and are pushed in the direction of the arrow G in FIG. 3. When the cartridge P is inserted as far as a predetermined position, positioning members 27R and 27L on the far side and the near side of the cartridge P are respectively positioned in the apparatus body 100, and the mounting of the cartridge P is completed.

(Grip Member Configuration)

Next, the configuration of the grip member 14*c*, which is a characteristic feature of the present exemplary embodiment, will be described. When the user is mounting or removing the cartridge P from the apparatus body 100, the ease of the mounting/removal operation of the cartridge P is improved by providing the grip member 14*c* that enables the user to grip the cartridge P. The grip member 14*c* needs to have high rigidity in order to withstand the load from the mounting/removal operation of the cartridge P.

Figure 1A:
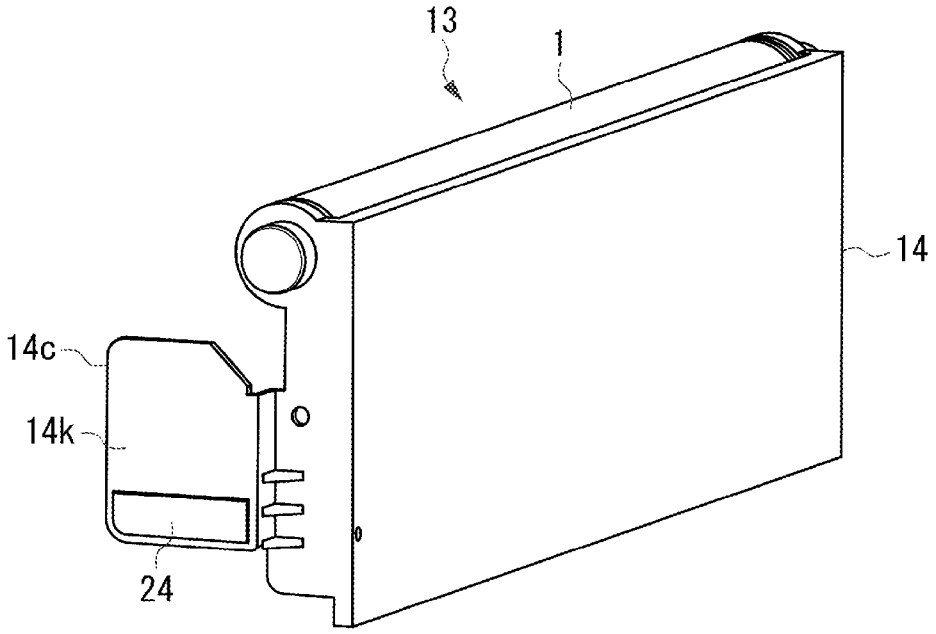
FIGS. 1A and 1B are perspective views of a cleaning unit according to a first exemplary embodiment.
Figure 1B:
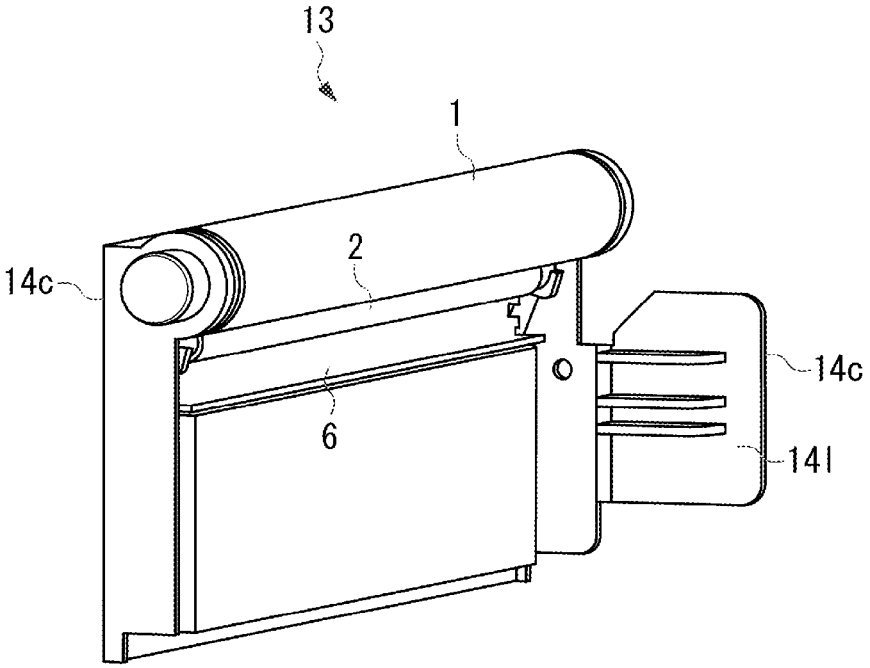

FIGS. 1A and 1B are perspective views of a cleaning unit according to the present exemplary embodiment. As illustrated in FIGS. 1A and 1B, in the present exemplary embodiment, the grip member 14*c* (a first molded member) is integrally molded with the cleaning frame member 14. The cleaning frame member 14 and the grip member 14*c* are formed from a resin X1 (a first resin). Examples of the resin X1 include, but are not limited to polystyrene.

In the present exemplary embodiment, of the faces to be gripped by the user, the face on the near side of the grip member 14*c* in FIGS. 1A and 1B will be referred to as a grip member front face 14*k*, and the face on the far side of the grip member 14*c* will be referred to as a grip member rear face 14*l*. Each of these faces form a face vertical to the mounting and dismounting direction of the cartridge P (the same direction as the longitudinal direction of the cartridge P). When mounting the cartridge P to the apparatus body 100, the user pushes the cartridge P by vertically pressing the grip member front face 14*k*. Further, when removing the cartridge P from the apparatus body 100, the user pulls the cartridge P toward the near side by vertically pressing the grip member rear face 14*l*. Specifically, the grip member front face 14*k* is a first face facing the direction in which the cartridge P is moved during mounting, and the grip member rear face 14*l*is a second face facing the direction in which the cartridge P is moved during removal.

The present disclosure integrally provides a two-color molded member 24 (a second molded member) illustrated in FIG. 1A by injecting a resin X2 (a second resin) onto the molded grip member 14*c*. The two-color molded member 24 is formed in the grip member 14*c* serving as the first molded member on the face of the grip member front face 14*k* so as to overlap with the movement direction during mounting/removal of the process cartridge P. In the present exemplary embodiment, similar to the grip member 14*c*, the two-color molded member 24 has a vertical face in the mounting and dismounting direction of the cartridge P.

Figure 5A:
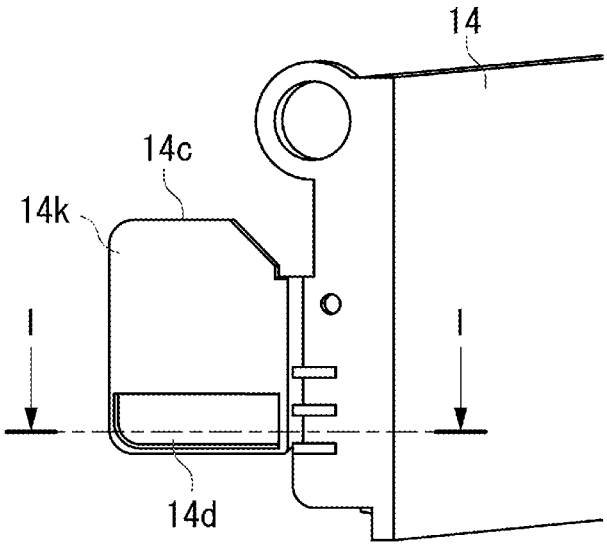
FIGS. 5A and 5B illustrate a configuration of a cleaning frame member according to a first exemplary embodiment.
Figure 5B:
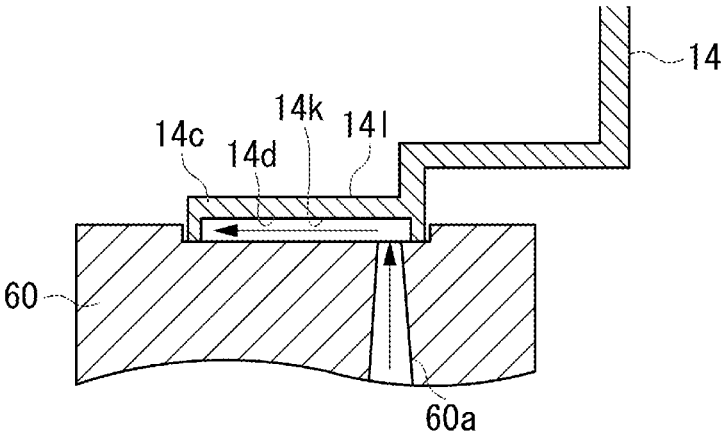

The method for molding the two-color molded member 24 will now be described with reference to FIGS. 5A and 5B. FIG. 5A is a partial perspective view of the cleaning frame member 14, and FIG. 5B is a cross-sectional view along the line I-I illustrated in FIG. 5A. In the present exemplary embodiment, the two-color molded member 24 is molded on the face of the grip member front face 14*k*. The portion where the grip member front face 14*k* joins with the two-color molded member 24 will be referred to as a joining face 14*d*.

First, a mold 60 for molding the two-color molded member 24 is mounted on the grip member front face 14*k*. Next, the resin X2 is injected into a resin channel 60*a* for injecting the resin X2. The injected resin X2 flows through a space between the grip member front face 14*k* and the mold 60, and the two-color molded member 24 is molded so as to cover the joining face 14*d* of the grip member 14*c*. Consequently, the two-color molded member 24 is integrally formed as a part of the grip member 14*c*.

The resin X2 forming the two-color molded member 24 may be the same resin material as the resin X1 that forms the cleaning frame member 14 and the grip member 14*c*, or may be a different resin material.

Thus, by providing the two-color molded member 24 on the grip member 14*c*, a thickness t2 of the two-color molded member 24 is added to a thickness t1 of the grip member 14*c* (thickness of the cleaning frame member 14) so that a thickness t3 of the portion that the user grips increases (t3=t1+t2). By increasing the thickness of the grip member 14*c* from t1→t3, when a load produced by the mounting/removal operation of the cartridge P is borne on the grip member 14*c*, the rigidity against the load in the mounting and dismounting direction is stronger.

Further, to make it easier for the user to recognize that the member is the grip member 14*c*, the color of the two-color molded member 24 can be made different to the color of the cleaning frame member 14. For example, if the cleaning frame member 14 is black, the two-color molded member 24 may be an easily visible color, such as aqua blue. By thus changing the color of the two-color molded member 24, the user can recognize that the grip member 14*c* is an operation member, so that usability improves.

As described above, the grip member 14*c* is provided on the cleaning frame member 14 formed from the resin X1. Further, the two-color molded member 24 is provided by injecting the resin X2 onto the grip member 14*c*. By thus forming the two-color molded member 24 on the grip member 14*c*, the grip member 14*c* can have a thickness that would be difficult to mold in one go into a desired shape due to the occurrence of sink marks. This can improve the strength of the grip member 14*c*. Consequently, when mounting/removing the cartridge P, deformation of the grip member 14*c* is suppressed, and the operation can be performed smoothly.

In the present exemplary embodiment, although the face that the two-color molded member 24 is formed on is the grip member front face 14*k*, the two-color molded member 24 may be formed on the grip member rear face 14*l*or on both of these faces, as long as the thickness of the grip member 14*c* can be increased by molding on at least one of the faces.

Further, in the present exemplary embodiment, the grip member 14*c* includes a support member extending from the cleaning frame member 14 in the mounting and dismounting direction of the cartridge P and a roughly cantilever beam-shaped member extending from this support member in a direction perpendicular to the mounting and dismounting direction. Further, the two-color molded member 24 is molded so as to extend toward the free edge from the support edge on the roughly cantilever beam-shaped member of the grip member 14*c*. Although in the present exemplary embodiment only one of the thus-configured two-color molded members 24 is molded, a plurality of these two-color molded members 24 can be molded in a line.

Further, in the present exemplary embodiment, although the grip member is provided in the cleaning frame member 14, the grip member may be provided in the development frame member 18.

The process cartridge according to a second exemplary embodiment of the present disclosure will now be described. The basic configuration of the development device, the process cartridges, and the image forming apparatus is the same as in the first exemplary embodiment. Therefore, elements having an identical, or equivalent, function and configuration to that in the first exemplary embodiment are denoted with the same reference numeral, and a detailed description of such elements is omitted here. Matters that are not especially described in the second exemplary embodiment are the same as in the first exemplary embodiment.

Figure 6A:
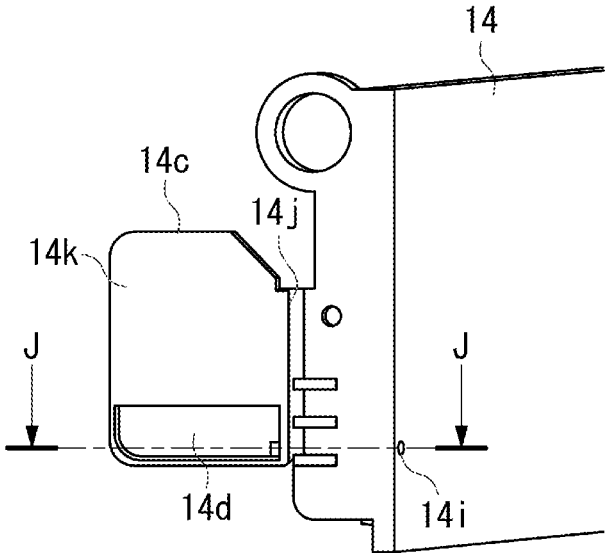
FIGS. 6A and 6B illustrate a configuration of a cleaning frame member according to a second exemplary embodiment.
Figure 6B:
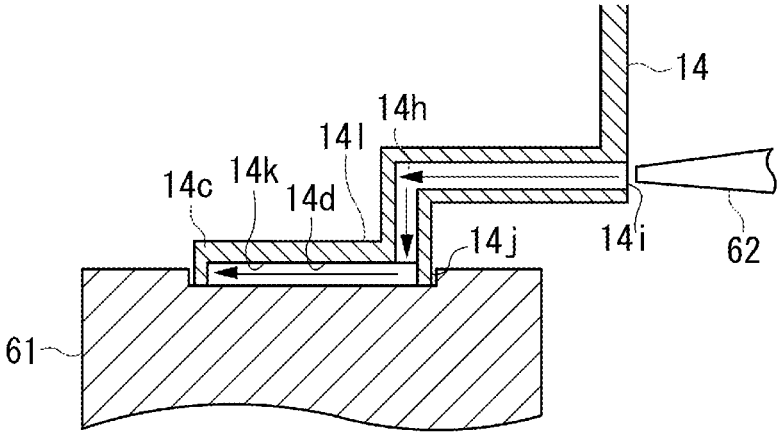

FIGS. 6A and 6B illustrate a configuration of a cleaning frame member according to the present exemplary embodiment. FIG. 6A is a partial perspective view of the cleaning frame member 14, and FIG. 6B is a cross-sectional view along the line J-J illustrated in FIG. 6A. The present exemplary embodiment differs from the first exemplary embodiment in that it includes a resin injection inlet 14*i* in the cleaning frame member 14. Further, as shown by the view along the J-J cross-section in FIG. 6B, the cleaning frame member 14 includes a resin channel 14*h*, which is a channel along which the resin X2 injected into the resin injection inlet 14*i* from a gate 62 flows. The resin channel 14*h* includes a channel that points in a direction that is not parallel to the joining face 14*d* between the grip member 14*c* and the two-color molded member 24. In the present exemplary embodiment, the resin channel 14*h* includes a channel that points in a direction perpendicular to the joining face 14*d* with the grip member 14*c*. Similar to the first exemplary embodiment, the two-color molded member 24 is molded by mounting a mold 61 on the grip member 14*c*, so that the injected resin X2 that has flowed along the resin channel 14*h* flows into a space between the grip member 14*c* and the mold 61.

When a force is acting on the grip member 14*c* in the normal direction to the joining face 14*d* due to the mounting/removal of the cartridge P, a force acts on a boundary portion 14*j*, which is a boundary between the grip member 14*c* and the cleaning frame member 14. If the force caused by this bending is large, the grip member 14*c* flexes at the boundary portion 14*j*. Accordingly, by providing the resin channel 14*h* in a direction that is not parallel to the joining face 14*d*, the rigidity of the boundary portion 14*j* is improved. Consequently, deformation of the boundary portion 14*j* can be suppressed even if a load is applied on the boundary portion 14*j* during mounting/removal of the cartridge P.

The same advantageous effects as in the first exemplary embodiment can be obtained even when the resin channel 14*h* is included in a direction that is not parallel to the joining face 14*d* of the grip member 14*c*, in the present exemplary embodiment.

Further, in the present exemplary embodiment, the two-color molded member 24 includes a first portion that extends in a movement direction (a first direction) during mounting/removal of the cartridge P, and a second portion that extends in a different direction to the first direction. Specifically, in a support member of the grip member 14*c*, the two-color molded member 24 according to the present exemplary embodiment includes an integrated molded member that extends in the movement direction during mounting/removal of the cartridge P. Moreover, in addition to the member that is integrally molded with the grip member 14*c*, the two-color molded member 24 according to the present exemplary embodiment includes a member that is integrally molded with the cleaning frame member 14. Consequently, the thickness of the support member of the grip member 14*c* and of locations where stress tends to concentrate becomes thicker, so that the rigidity of the grip member 14*c* against loads produced during pushing and pulling of the cartridge by the user can be increased even further.

The process cartridge according to a third exemplary embodiment of the present disclosure will now be described. The basic configuration of the development device, the process cartridges, and the image forming apparatus is the same as in the first exemplary embodiment. Therefore, elements having an identical, or equivalent, function and configuration to that in the first exemplary embodiment are denoted with the same reference numeral, and a detailed description of such elements is omitted here. Matters that are not especially described in the third exemplary embodiment are the same as in the first exemplary embodiment.

Figure 7:
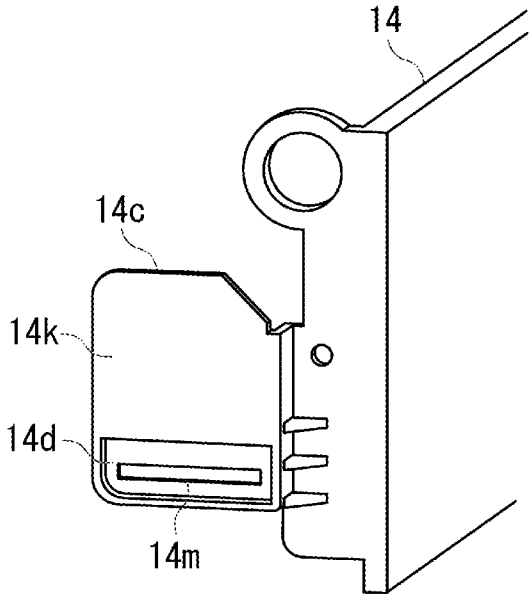
FIG. 7 is a partial perspective view of a cleaning frame member according to a third exemplary embodiment.

FIG. 7 is a partial perspective view of a cleaning frame member according to the present exemplary embodiment. As illustrated in FIG. 7, a groove 14*m* is provided in a joining face with the two-color molded member 24 in the grip member 14*c*. By providing this groove 14*m*, when injecting the resin X2 that forms the two-color molded member 24, the area through which the resin X2 flows widens, so that it is easier for the resin X2 to flow. Since the fluidity of the resin X2 improves, the moldability of the two-color molded member 24 is improved.

Further, by providing this groove 14*m*, the area where the grip member 14*c* and the two-color molded member 24 are in contact is widened, and the two-color molded member 24 is hardly peeled away from the grip member 14*c*. In the present exemplary embodiment, although the groove 14*m* is provided so as to extend from the support end to the free end, the present disclosure is not limited to this configuration. Moreover, in the present exemplary embodiment, although only one groove 14*m* is provided, a plurality of grooves may be provided.

The process cartridge according to a fourth exemplary embodiment of the present disclosure will now be described. The basic configuration of the development device, the process cartridges, and the image forming apparatus is the same as in the first exemplary embodiment. Therefore, elements having an identical, or equivalent, function and configuration to that in the first exemplary embodiment are denoted with the same reference numeral, and a detailed description of such elements is omitted here. Matters that are not especially described in the fourth exemplary embodiment are the same as in the first exemplary embodiment.

Figure 8A:
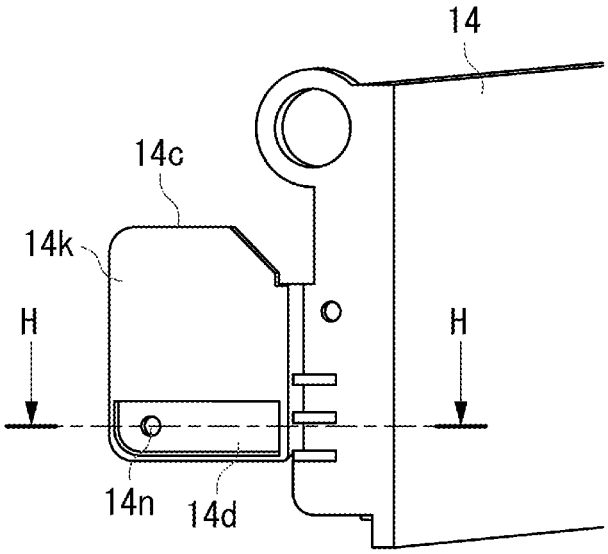
FIGS. 8A and 8B illustrate a configuration of a cleaning frame member according to a fourth exemplary embodiment.
Figure 8B:
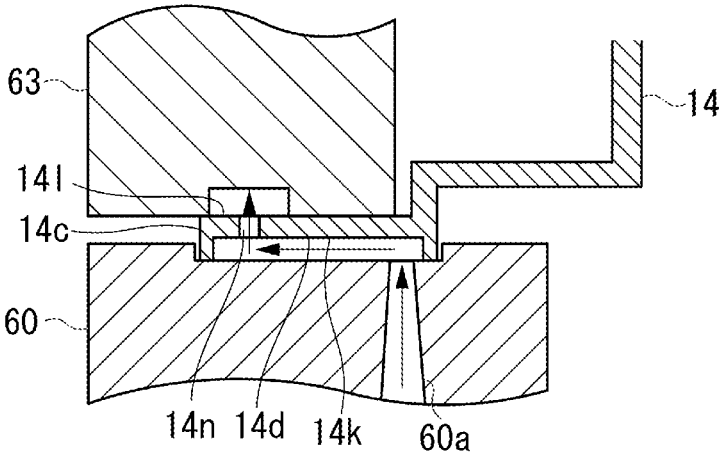
Figure 9A:
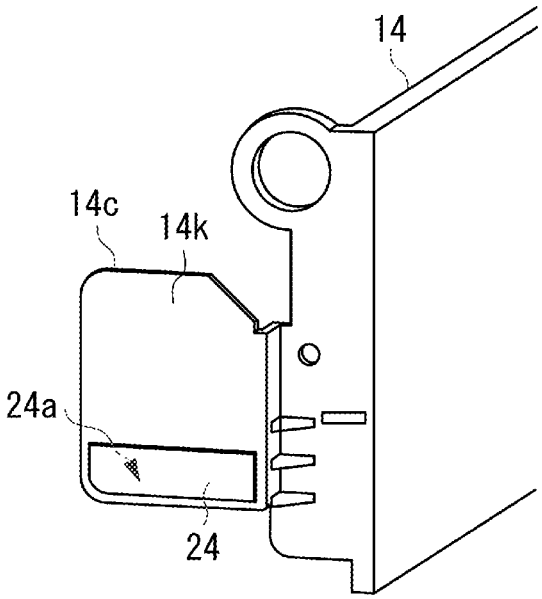
FIGS. 9A and 9B are partial perspective views of a cleaning frame member and a two-color molded member according to a fourth exemplary embodiment.
Figure 9B:
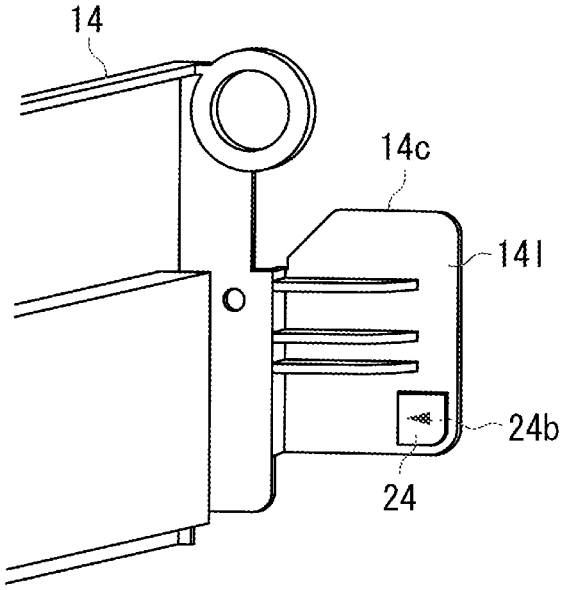

FIGS. 8A and 8B illustrate the configuration of the cleaning frame member according to the present exemplary embodiment. FIG. 8A is a partial perspective view of the cleaning frame member 14, and FIG. 8B is a cross-sectional view along the line H-H illustrated in FIG. 8A. FIGS. 9A and 9B are partial perspective views of a cleaning frame member and a two-color molded member according to the present exemplary embodiment. The present exemplary embodiment differs from the first exemplary embodiment in that the two-color molded member 24 includes a joining portion on both faces of the grip member 14*c*. Specifically, the two-color molded member 24 has a face 24*a* (see FIG. 9A) facing the direction in which the cartridge P is mounted to the apparatus body 100, and a face 24*b* (see FIG. 9B) facing the direction in which the cartridge P is dismounted from the apparatus body 100. In the present exemplary embodiment, the portion having the face 24*a* of the two-color molded member 24 joins with the grip member front face 14*k*, and the face 24*b* of the two-color molded member 24 joins with the grip member rear face 14*l*.

The method for forming the two-color molded member 24 will be described with reference to FIGS. 8A and 8B. In the present exemplary embodiment, the grip member 14*c* includes an aperture portion (a through-hole) 14*n* penetrating from the grip member front face 14*k* to the grip member rear face 14*l*. First, as illustrated by the view along the H-H cross-section of FIG. 8B, a mold 60 is mounted on the grip member front face 14*k*, and a mold 63 is mounted on the grip member rear face 14*l*. Next, the resin X2 is injected from a resin channel 60*a* of the mold 60. The resin X2 passes through the aperture portion 14*n* from the grip member front face 14*k*, and reaches the grip member rear face 14*l*. The two-color molded member 24 is formed from the mold 60 and the mold 63. Consequently, the two-color molded member 24 is formed by the portion having the face 24*a* and the portion having the face 24*b* that are joined to the grip member front face 14*k* and the grip member rear face 14*l*, respectively.

As described above, the two-color molded member 24 is joined to the grip member 14*c* at both the portion having the face 24*a* that faces the direction in which the cartridge P is mounted to the apparatus body 100, and the portion having the face 24*b* that faces the direction in which the cartridge P is dismounted from the apparatus body 100. Consequently, the portion having the face 24*a* and the portion having the face 24*b* of the 24 act as a stopper in the mounting and dismounting direction of the cartridge P, so that peeling of the two-color molded member 24 can be prevented.

The above-described respective exemplary embodiments can employ a configuration in which the exemplary embodiments are combined with each other as much as possible.

As described above, according to the present disclosure, the strength of a grip member on a frame member in a cartridge detachably mountable to an image forming apparatus can be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-214640 filed Sep. 27, 2012, which is hereby incorporated by reference herein in its entirety.

What is claimed is:

1. A cartridge for detachably mounting to an apparatus body of an image forming apparatus in a mounting and dismounting direction, the cartridge comprising:

a frame formed of a first resin; and a grip provided on the frame for gripping the cartridge when the cartridge is mounted on or dismounted from the apparatus body, the grip including a first molded portion integrally molded with the frame, and a second molded portion formed of a second resin integrally molded with the first molded portion after the molding of the first molded portion, wherein the second molded portion is molded on the first molded portion in the mounting and dismounting direction.

2. The cartridge according to claim 1, wherein the first molded portion includes a first face that faces the direction in which the cartridge is dismounted from the apparatus body, and a second face that faces the direction in which the cartridge is mounted onto the apparatus body, and wherein the second molded portion is molded on at least either one of the first face and the second face.

3. The cartridge according to claim 1, wherein the first molded portion and the second molded portion are each a different color.

4. The cartridge according to claim 1, wherein the second molded portion includes a first portion that extends in the mounting and dismounting direction, and a second portion that extends in a different direction to the first direction.

5. The cartridge according to claim 1, wherein the frame includes an injection inlet configured to inject the second resin for molding the second molded portion on the first molded portion and a channel along which the second resin, which is injected from the injection inlet, flows.

6. The cartridge according to claim 1, wherein the first molded portion has a groove on a first face or a second face.

7. The cartridge according to claim 1, wherein the groove extends from a support end on which the grip is supported on the frame to a free end of the grip.

8. The cartridge according to claim 1, wherein the first resin and the second resin are the same material.

9. The cartridge according to claim 2, wherein the first molded portion has a through-hole penetrating in the mounting and dismounting direction, and the second molded portion passes through the through-hole.

10. The cartridge according to claim 9, wherein the second molded portion engages with the first face and the second face to prevent disengaging from the first molded portion.

11. The cartridge according to claim 1, wherein the cartridge further comprises a cleaning unit configured to support a photosensitive drum and a development unit configured to support a development roller for developing a latent image formed on the photosensitive drum.

12. The cartridge according to claim 11, wherein the grip is provided on the cleaning unit.

13. The cartridge according to claim 11, wherein the grip is provided on the development unit.

14. The cartridge according to claim 11, wherein the mounting and dismounting direction is a direction along a shaft direction of the photosensitive drum.

* * * * *